US008051954B2

(12) United States Patent
Pustelniak

(10) Patent No.: US 8,051,954 B2
(45) Date of Patent: Nov. 8, 2011

(54) METHOD AND SYSTEM FOR COMMUNICATING WITH A CONTROLLER OF AN ELEVATOR

(75) Inventor: Richard D. Pustelniak, Tucson, AZ (US)

(73) Assignee: Otis Elevator Company, Farmington, CT (US)

( * ) Notice: Subject to any disclaimer, the term of this patent is extended or adjusted under 35 U.S.C. 154(b) by 551 days.

(21) Appl. No.: 11/990,063

(22) PCT Filed: Aug. 8, 2005

(86) PCT No.: PCT/US2005/028152

§ 371 (c)(1),
(2), (4) Date: Mar. 6, 2009

(87) PCT Pub. No.: WO2007/018539

PCT Pub. Date: Feb. 15, 2007

(65) Prior Publication Data

US 2009/0314583 A1 Dec. 24, 2009

(51) Int. Cl.
*B66B 13/26* (2006.01)

(52) U.S. Cl. ..... 187/317; 187/391; 49/27

(58) Field of Classification Search ..... 187/247, 187/316, 317, 391–393; 318/280–286, 466–469; 49/25–28

See application file for complete search history.

(56) References Cited

U.S. PATENT DOCUMENTS

| | | | | |
|---|---|---|---|---|
| 2,932,365 | A * | 4/1960 | Hornung | 187/317 |
| 4,491,917 | A * | 1/1985 | Higgins et al. | 701/49 |
| 4,866,881 | A * | 9/1989 | Morrow et al. | 49/25 |
| 5,149,921 | A * | 9/1992 | Picado | 187/317 |
| 5,247,139 | A * | 9/1993 | Schon et al. | 187/394 |
| 5,392,879 | A | 2/1995 | Boyce et al. | |
| 5,982,125 | A * | 11/1999 | Ranaudo et al. | 318/466 |
| 6,167,991 | B1 * | 1/2001 | Full et al. | 187/317 |
| 6,247,558 | B1 * | 6/2001 | Bailey et al. | 187/317 |
| 6,279,687 | B1 * | 8/2001 | Pustelniak et al. | 187/317 |
| 6,392,537 | B1 | 5/2002 | Tazumi et al. | |
| 6,854,565 | B2 | 2/2005 | Peralact et al. | |
| 7,123,144 | B2 * | 10/2006 | Anderson et al. | 340/545.1 |
| 2001/0042820 | A1 * | 11/2001 | Wilson | 250/221 |
| 2008/0304039 | A1 * | 12/2008 | De Coi | 356/4.1 |

FOREIGN PATENT DOCUMENTS

| | | | |
|---|---|---|---|
| JP | 4246085 | A | 9/1992 |
| JP | 11349248 | A | 12/1999 |
| WO | W02004/056692 | | 7/2004 |

* cited by examiner

*Primary Examiner* — Anthony Salata
(74) *Attorney, Agent, or Firm* — Kinney & Lange, P.A.

(57) ABSTRACT

The present invention includes a method and a system for communicating with a controller of an elevator car (10). A first input device (40) is inserted between a pair of elevator car sliding doors (12, 14). Energy beams (36) transmitted between the pair of elevator sliding doors (12, 14) are selectively blocked to communicate information to the controller.

20 Claims, 4 Drawing Sheets

METHOD AND SYSTEM FOR COMMUNICATING WITH A CONTROLLER OF AN ELEVATOR

BACKGROUND OF THE INVENTION

The present invention relates generally to the field of elevator installation and maintenance. More specifically, the present invention relates to a method and a system for communicating with an elevator controller.

Various features, operations, or parameters associated with an elevator system may need to be modified or configured by maintenance or installation personnel. This frequently requires taking the elevator system out of service for a period of time. Depending upon the nature of the modification or configurations to be made, access to the top of the elevator car may be required to complete these activities. In addition, these activities may require maintenance personnel to, for example, install safety barricades, flip switches, and/or install configuration jumpers.

BRIEF SUMMARY OF THE INVENTION

The present invention includes a method and a system for communicating a code to an elevator car equipped with a multi-beam door safety system. An input device is used to selectively block one or more energy beams of the door safety system. A controller associated with the door safety system determines which energy beams are blocked and unblocked and inputs a code as a function of the blocked and unblocked beams.

DETAILED DESCRIPTION

The present invention includes a system and a method for communicating with an elevator car equipped with a door safety system. In elevator installations, elevator car sliding doors are frequently equipped with door safety systems that use energy beams transmitted between the doors to detect potential interference with the closing operation of the doors. The present invention utilizes an input device to selectively block energy beams of a door safety system to communicate a code to a controller associated with the elevator car of the elevator installation.

Figure 1:
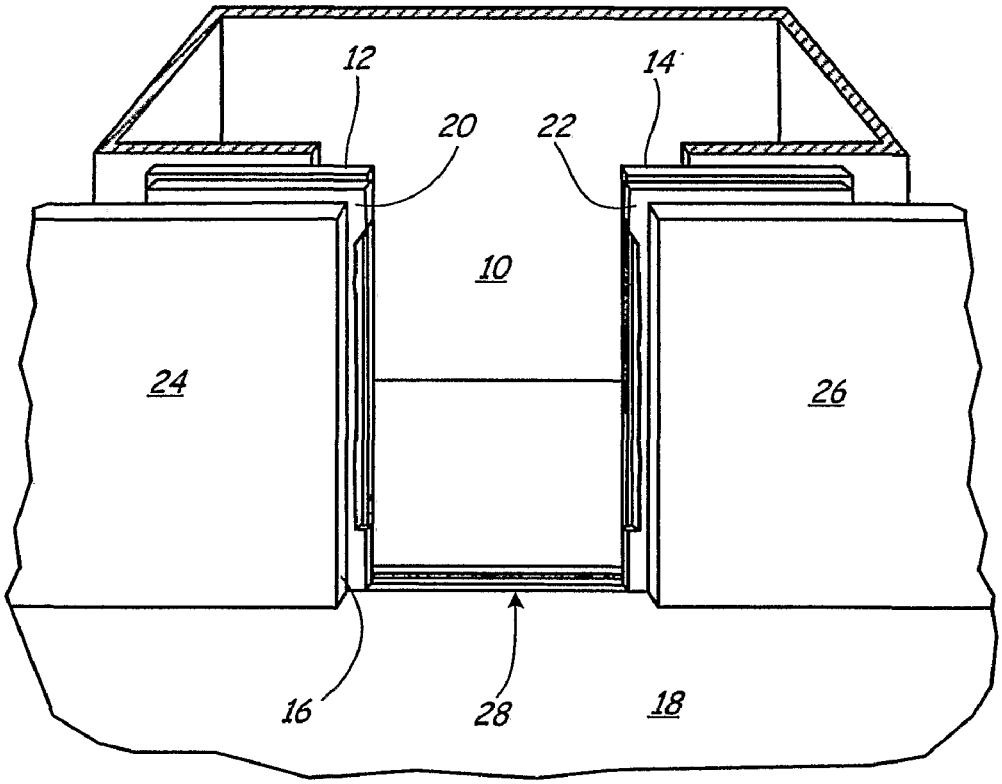
FIG. 1 is a partial front view of an elevator installation including an elevator car equipped with a door safety system having a pair of elevator car sliding doors.

FIG. 1 shows an elevator car 10 equipped with a pair of opposing elevator car sliding doors 12 and 14 for gaining access to a doorway 16 of floor 18. Hallway sliding doors 20 and 22 are provided on floor 18 adjacent to walls 24 and 26 to seal off doorway 16 when elevator car 10 is not located at floor 18. Each set of sliding doors (i.e., elevator car sliding doors 12 and 14 and hallway sliding doors 20 and 22) slide open and closed together across a threshold 28 of doorway 16.

Figure 2:
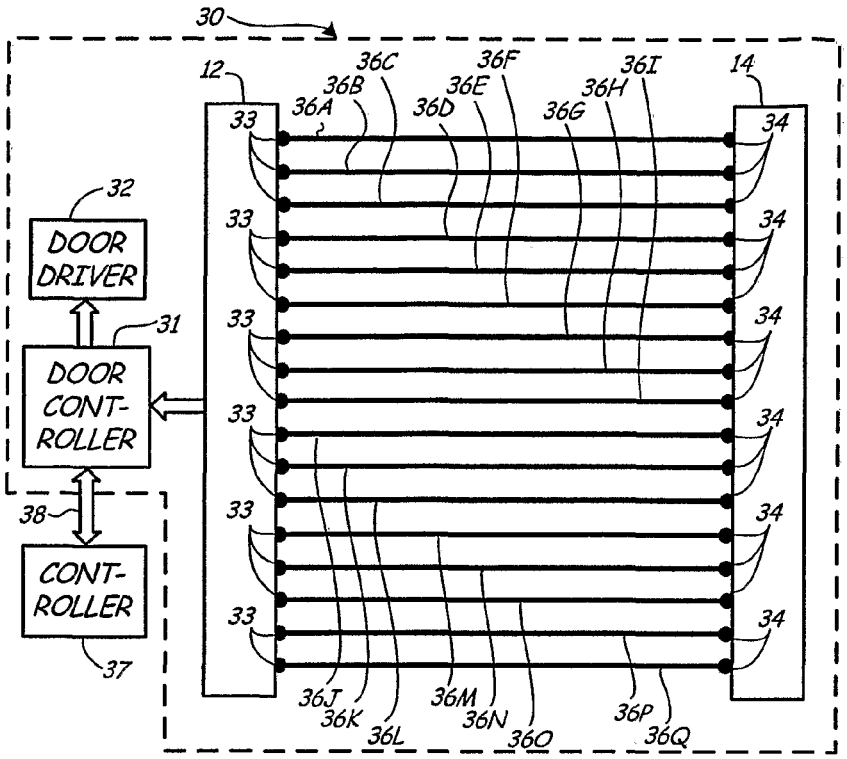
FIG. 2 is a front schematic view of the elevator car sliding doors of FIG. 1 with energy beams transmitted between the doors.

Elevator car 10 is equipped with door safety system 30 that includes elevator car sliding doors 12 and 14, door controller 31, door drive 32, a plurality of receivers 33, and a plurality of transmitters 34, as shown in FIG. 2. Receivers 33 and transmitters 34 are disposed on opposite sides of doorway 16 on doors 12 and 14, respectively. Door controller 31 communicates with receivers 33 and controls the opening and closing of doors 12 and 14 via door drive 32. In some embodiments, door controller 31 includes a microprocessor for executing programmable logic related to the functioning of doors 12 and 14.

In operation, safety system 30 prevents elevator car doors 12 and 14 from closing if an object or person is detected in doorway 16. Each transmitter 34 emits an energy beam 36A-36Q that, in the absence of an obstruction, is transmitted across doorway 16 and received by a receiver 33, as shown in FIG. 2. Receivers 33 produce signals as a function of energy beams 36A-36Q and communicate the signals to door controller 31. If an energy beam 36A-36Q is interrupted when doors 12 and 14 are either open or closing, door controller 31 keeps doors 12 and 14 open or reverses the closing operation using door drive 32.

Energy beams 36A-36Q can be any type, or combination, of energy beams known in the art for use with elevator door safety systems. Examples of energy beams 36A-36Q include infrared energy beams, visible light energy beams, ultrasonic energy beams, and focused radar energy beams.

As shown in FIG. 2, door controller 31 is in communication with controller 37 via optional communication link 38. Controller 37 can be any controller associated with elevator car 10 including, for example, a controller for controlling the vertical location of elevator car 10. Communication link 38 allows input device 40 to communicate information to controller 37 via door controller 31.

Figure 3:
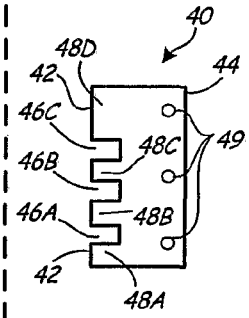
FIG. 3 is a front view of an input device for communicating a code to a controller of the elevator car of FIG. 1.

FIG. 3 shows a side view of an input device 40 of the present invention for communicating a code to a controller associated with elevator car 10 of FIG. 1. Input device 40 includes opposing edges 42 and 44, a plurality of slots 46A-46C formed in edge 42, and a plurality of blocking members 48A-48D adjacent to slots 46A-46C. Slots 46A-46C and blocking members 48A-48D are configured to selectively block energy beams 36. The collective configuration of slots 46A-46C and blocking members 48A-48D (i.e., the shape, size, number, and/or location of slots 46 and blocking members 48) form a blocking pattern that is representative of (or encodes) a code for inputting into a controller included in, or in communication with, safety system 30. Different codes may be represented by different blocking patterns.

In some embodiments, input device 40 is formed from a rigid, opaque sheet of material such as, for example, cardboard or metal. As shown in FIG. 3, input device 40 includes optional mounting holes 49 and is suitably sized so that input device 40 may be mounted in a 3-ring binder for organizational purposes. In one embodiment, input device 40 is formed from a sheet that is about 8.5 inches wide by about 11 inches tall.

Figure 4:
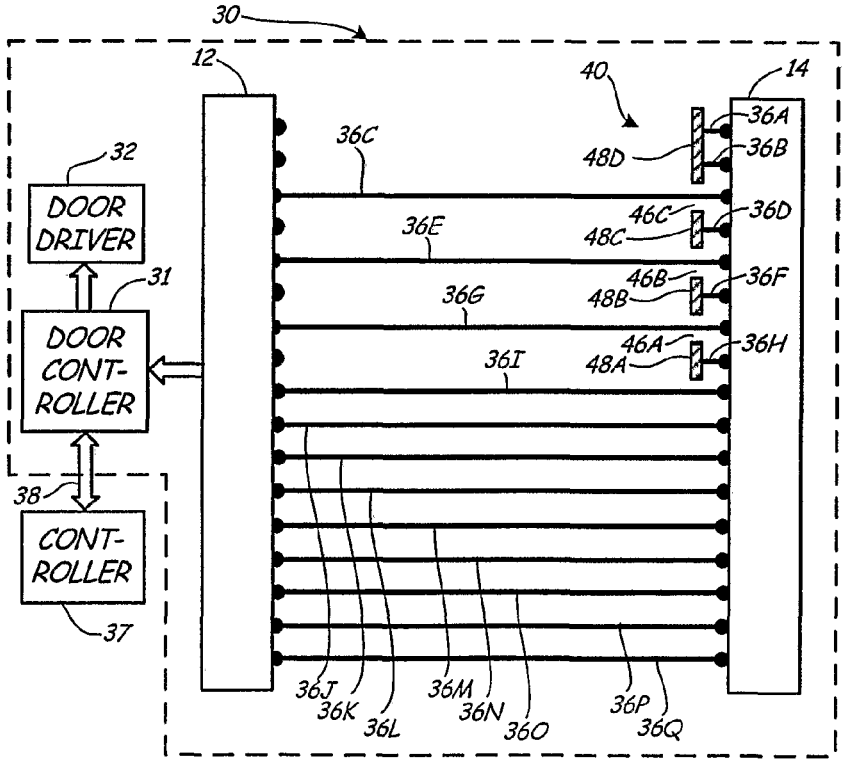
FIG. 4 is a front schematic view of the input device of FIG. 3 shown in section inserted between the elevator car sliding doors to selectively block the energy beams of FIG. 2.

FIG. 4 shows a front schematic representation of input device 40 positioned in doorway 16 (with edge 42 facing the interior of elevator car 10) to communicate a code to a controller associated with elevator car 10. For purposes of clarity, input device 40 is shown in section. Input device 40 is positioned relative to energy beams 36A-36Q so that blocking member 48D blocks uppermost energy beams 36A and 36B; blocking members 48A, 48B, and 48C block energy beams 36H, 36F, and 36D, respectively; and slots 46A, 46B, and 46C allow for passage of beams 36G, 36E, and 36C, respectively, through input device 40.

Pursuant to the method of the present invention, input device 40 may be positioned at any vertical height within doorway 16 and at any horizontal position between elevator car sliding doors 12 and 14. As shown in FIG. 4 (which is not drawn to scale), input device 40 is positioned near elevator car door 14 at a suitable vertical height so that blocking member 48D blocks uppermost energy beams 36A and 36B. In some embodiments, energy beam barrier 40 must be vertically positioned as shown in FIG. 4 to be acknowledged by elevator car 10. By requiring input device 40 to be positioned near the top of doorway 16, the potential for obstructions within doorway 16 being mistaken for input device 40 are reduced.

Slots 46A-46C of input device 40 are but one example of energy-beam transmitting regions for use with an input device of the present invention. In some embodiments, input device 40 may include energy-beam transmitting regions in the form of gaps or apertures of any shape formed in input device 40. In other embodiments, input device 40 may include energy-beam transmitting regions that comprise transparent portions that are capable of transmitting an energy beam through the input device. Some of these transparent portions may be able to alter their transparency to alter the blocking pattern of input device 40, which may be accomplished, for example, using liquid crystal and/or electro chromic technologies.

Figure 5:
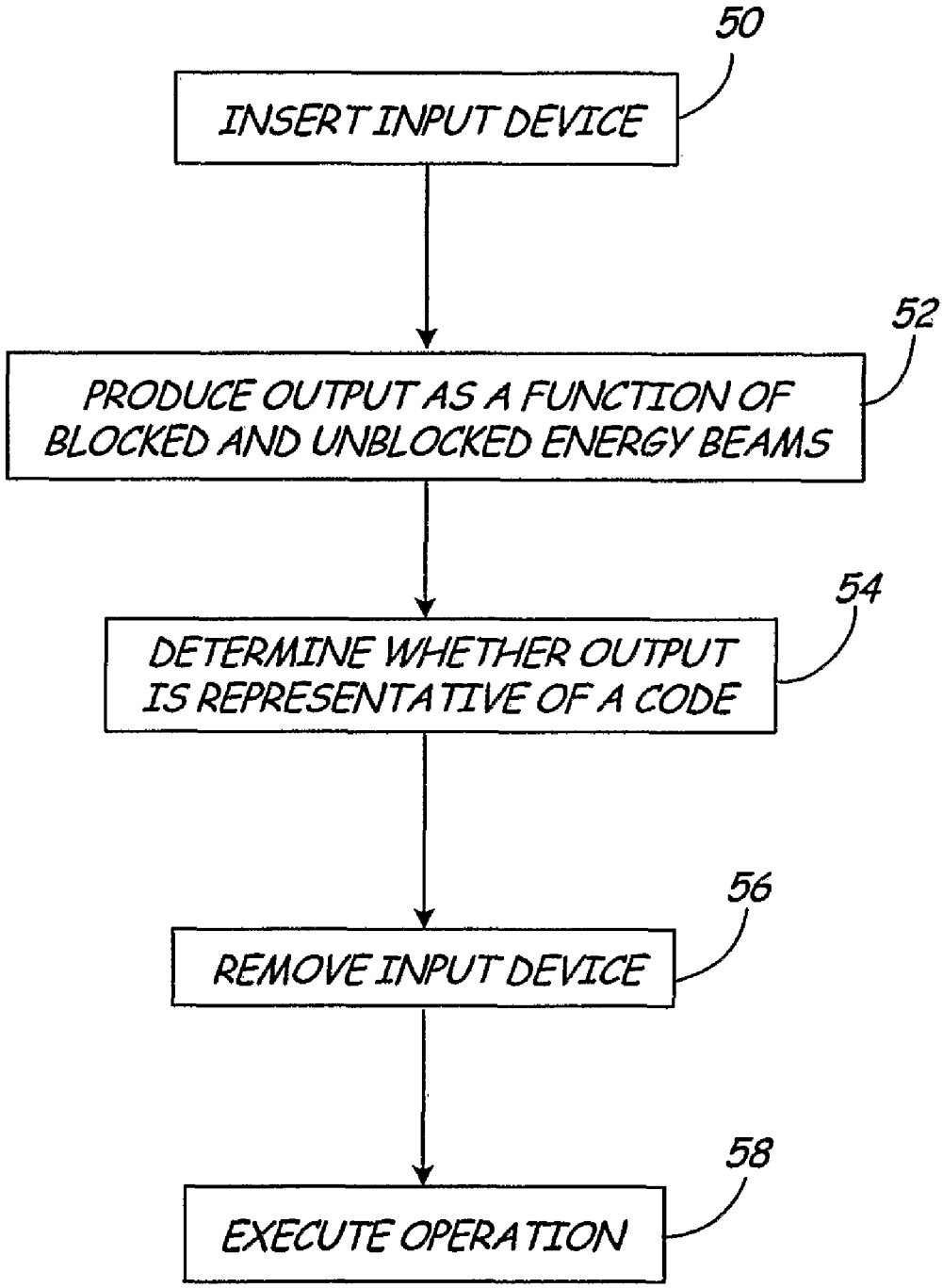
FIG. 5 is a block diagram of a method for using the input device of FIG. 3 to communicate the code to a controller associated with the elevator car of FIG. 1.

FIG. 5 illustrates a method of the present invention for using input device 40 to communicate a code to a controller associated with elevator car 10. Pursuant to the method of FIG. 5, input device 40 is inserted into doorway 16 between elevator sliding doors 12 and 14 (step 50), as shown in FIG. 4. This causes doors 12 and 14 to open to a fully open position, if doors 12 and 14 are not already in such an orientation. A controller (e.g., door controller 31) included, or in communication with, safety system 30, produces an output as a function of the blocked and unblocked energy beams 36 (step 52). The controller determines if the output is representative of a recognized code for input device 40 (step 54). The controller then waits for a set period of time to determine whether the combination of blocked and unblocked beams changes (i.e., whether the blocking pattern changes). If the blocking pattern changes during this waiting period, then the controller considers the blocked energy beams as not having resulted from input device 40.

If the blocking pattern does not change during the waiting period, the controller executes an operation as a function of the blocking pattern (and hence the code) of input device 40 (step 58). This operation may be, for example, to execute an elevator instruction as a function of the code or to communicate the code or elevator instruction to another controller or subsystem associated with elevator car 10. In some embodiments, the controller does not execute the operation of step 58 until input device 40 has been removed from doorway 16.

In some embodiments, the code is a numerical value that is representative of an elevator instruction, which can be any type of elevator instruction known in the art. Examples of such elevator instructions include instructions to trigger the calibration of a system (e.g., safety system 30), instructions to reset one or more parameters associated with a system, instructions to set a parameter to a particular value or range of values, instructions to enable or disable a criss-cross transmission pattern for energy beams 36, instructions to enable or disable a graceful degradation setting for safety system 30, instructions to indicate which energy beam 36 is blocked or otherwise malfunctioning, instructions to enable or disable an auditory annunciation in response to blockages of energy beams 36, instructions to place elevator car 10 in a special mode, any combination of these, or any other type of elevator instruction known in the art. In one embodiment, the numerical value represents an instruction to execute a calibration operation related to door safety system 30.

In some embodiments, some or all of slots 46 and/or blocking members 48 (or portions thereof capable of blocking or transmitting a single energy beam 36A-36Q) are representative of a binary "0" or "1". In one embodiment of input device 40 of FIG. 2, slots 46A and 46B and blocking members 48A-48C each represent a binary "0" or "1", which collectively indicate a value representative of an elevator instruction. Slot 46C and blocking member 48D provide an indication that an input device 40 is positioned within doorway 16 (as opposed to some other blocking object).

Figure 6:
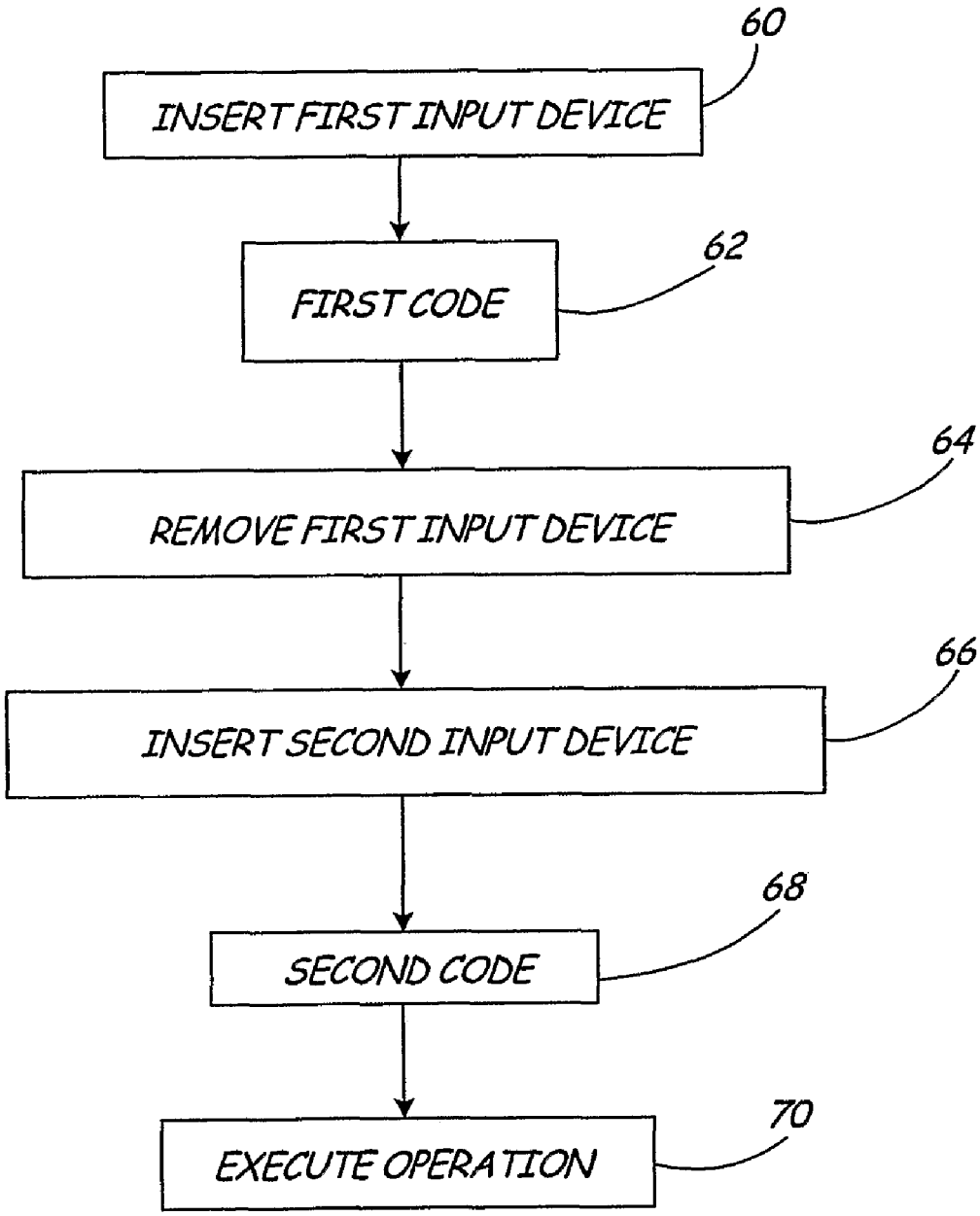
FIG. 6 is a block diagram of a method for using a plurality of input devices of FIG. 3 to communicate a plurality of codes to a controller associated with the elevator car of FIG. 1.

FIG. 6 illustrates a method of the present invention for using a plurality of input devices 40 to communicate with a controller associated with elevator car 10. A first input device 40 having a first blocking pattern representative of a first code is inserted into doorway 16 between elevator sliding doors 12 and 14 (step 60), as shown in FIG. 4. A controller (e.g., door controller 31) associated with elevator car 10 derives the first code as a function of the first blocking pattern (step 62). The first input device is removed from doorway 16 (step 64). A second input device having a second blocking pattern representative of a second code is inserted into doorway 16 between elevator sliding doors 12 and 14 (step 66). The controller derives the second code as a function of the second blocking pattern (step 68). The controller then executes an operation as a function of the first and second codes (step 70). Similar to the operation of FIG. 5 (step 58), the operation in step 70 may be, for example, to execute an elevator instruction as a function of the codes or to communicate one or more of the codes to another controller associated with elevator car 10.

The first and second codes may have a contextual relationship to one another. For example, the first code can indicate a parameter to be modified or set and the second code can indicate a value for that parameter. In some embodiments, more than two input devices may be used to perform a task.

In some embodiments of the methods of FIGS. 5 and 6, if an energy beam 36A-36Q, other than one being blocked by input device 40, is blocked during the recognition process of input device 40, then the recognition process ceases. Input device 40 must then be removed from doorway 16 of FIG. 1 and reinserted to restart the recognition process.

Thus, as described above, the methods and communication systems of the present invention provide a means for communicating a code to a controller of an elevator car using energy beams of a door safety system.

Although the present invention has been described with reference to preferred embodiments, workers skilled in the art will recognize that changes may be made in form and detail without departing from the spirit and scope of the invention.

The invention claimed is:

1. A method for communicating with an elevator including a door safety system to detect objects in a path between a pair of opposing sliding doors, the method comprising:

inserting a first input device between the pair of sliding doors; and selectively blocking one or more of a plurality of energy beams transmitted between the pair of sliding doors with the first input device to communicate a first code to a controller associated with the elevator.

2. The method of claim 1, wherein the controller comprises a door controller.

3. The method of claim 2, and further comprising:

communicating the first code from the door controller to a different controller associated with the elevator.

4. The method of claim 1, wherein the first input device is inserted between the pair of sliding doors so that it blocks an uppermost energy beam.

5. The method of claim 1, wherein the first code comprises a value for a parameter.

6. The method of claim 5, wherein the first code comprises an instruction to execute a calibration operation related to the door safety system.

7. The method of claim 1, and further comprising:

inserting a second input device between the pair of sliding doors to selectively block one or more of the plurality of energy beams and communicate a second code comprising a value for a parameter, wherein the first code comprises the parameter.

8. A method for use with an elevator car having an elevator door safety system, the method comprising;

producing an output as a function of blocked and unblocked energy beams of the elevator door safety system, the energy beams transmitted between a pair of sliding doors for accessing floors of a building to detect objects in a path of the doors, and processing the output to determine whether it is representative of a recognized code.

9. The method of claim 8, and further comprising:

communicating the output or code to a different controller associated with the elevator car.

10. The method of claim 8, and further comprising:

executing an operation as a function of the code.

11. A system for communicating with a controller associated with an elevator, the device comprising:

a first input device sized for insertion in a path between a pair of elevator sliding doors;

a first blocking pattern included in the first input device, the first blocking pattern configured to selectively block energy-beams transmitted between the pair of elevator sliding doors, the first blocking pattern representative of a first code.

12. The system of claim 11, wherein the first blocking pattern comprises one or more energy-beam transmitting regions formed in the first input device.

13. The system of claim 11, wherein the one or more energy-beam-transmitting regions comprise one or more slots formed in the first input device to allow for passage of one or more energy beams through the first input device.

14. The method of claim 11, wherein the first code comprises an instruction to execute a calibration operation related to a door safety system.

15. The system of claim 11, and further comprising:

a second input device having a second blocking pattern configured to selectively block the energy beams, the second blocking pattern representative of a second code.

16. The system of claim 15, wherein the first and second codes have a contextual relationship to one another.

17. The system of claim 16, wherein the first code comprises an elevator parameter and the second code comprises a value for the elevator parameter.

18. The system of claim 11, wherein the first input device comprises a sheet of material.

19. The system of claim 18, wherein the first input device includes mounting holes formed in the sheet of material for mounting the first input device in a binder.

20. An elevator system comprising:

an elevator car;

a first and second sliding door located on a face of the elevator car for accessing building floors; and a door safety system, the door safety system comprising:

receivers located on the first sliding door;

transmitters located on the second sliding door configured to transmit energy beams to the receivers on the first sliding door; and a door controller configured to detect interruptions in the energy beams caused by insertion of an input device between the first and second sliding doors and derive a code as a function of a blocking-pattern of the input device.

* * * * *